United States Patent [19]

Paljakka

[11] Patent Number: 4,619,312

[45] Date of Patent: Oct. 28, 1986

[54] VENTILATING WALL ELEMENT

[76] Inventor: Olavi O. Paljakka, Stenbockens gata 114 6tr, S-136 62 Handen, Sweden

[21] Appl. No.: 551,993

[22] PCT Filed: Feb. 21, 1983

[86] PCT No.: PCT/SE83/00054

§ 371 Date: Oct. 24, 1983

§ 102(e) Date: Oct. 24, 1983

[87] PCT Pub. No.: WO83/02972

PCT Pub. Date: Sep. 1, 1983

[30] Foreign Application Priority Data

Feb. 24, 1982 [SE] Sweden ..... 8201142-0

[51] Int. Cl.[4] ..... B01J 8/00

[52] U.S. Cl. ..... 165/57; 165/908

[58] Field of Search ..... 165/DIG. 12, 57, 164, 165/165

[56] References Cited

U.S. PATENT DOCUMENTS

| | | | |
|---|---|---|---|
| 3,666,007 | 5/1972 | Yoshino et al. | 165/DIG. 12 X |
| 4,040,804 | 8/1977 | Harrison | 165/DIG. 12 X |
| 4,051,898 | 10/1977 | Yoshino et al. | 165/DIG. 12 X |
| 4,155,981 | 5/1979 | Chubb | 165/DIG. 12 X |
| 4,232,821 | 11/1980 | Backlund | 165/DIG. 12 X |

FOREIGN PATENT DOCUMENTS

| | | | |
|---|---|---|---|
| 37790 | 10/1981 | European Pat. Off. . | |
| 2523151 | 4/1976 | Fed. Rep. of Germany | 165/DIG. 12 |
| 60262 | 1/1939 | Norway . | |
| 393421 | 5/1977 | Sweden . | |
| 410880 | 11/1979 | Sweden . | |
| 80019524 | 9/1981 | Sweden . | |

*Primary Examiner*—Harold Joyce

*Attorney, Agent, or Firm*—Cushman, Darby & Cushman

[57] ABSTRACT

A sphere of house building technology and refers to the heat-insulating part of an outer wall in a building. Also other walls in the building may be suitable if there are temperature differences between spaces and a need for ventilation. The basic principle consists in the wall construction itself constituting a heat exchanger of counterflow type and transmitting both humidity and heat from the exhaust air (fresh air) to the fresh air (exhaust air). At the same time the same surface temperature is achieved as that of the ambient air.

1 Claim, 5 Drawing Figures

(A-A)

VENTILATING WALL ELEMENT

In the assembled state the ventilating wall elements are intended to form the heat insulating part of an outer wall in a house building. (Where applicable the term wall also includes floors and ceilings.) Also other building walls may be appropriate, if there are temperature differences between spaces and a need for ventilation.

The problems underlying the invention are dealt with in the manual Bygg, del 6: Husbyggnadsteknik (Building, part 6: House building technology).

The energy losses which occur when ventilating heated (or cooled) spaces are considerable; e.g. in a dwelling house in northern latitudes the heat losses due to ventilation are about equally large as the heat flow through insulated walls and the ceiling. In workshops, where there is a major need for ventilation, the losses too are multiplied.

A well known difficulty which arises when ventilating heated spaces consists in the dry room air. Comprehensive air conditioning systems are frequently too expensive and take too much space. Also the heat recovery systems currently available cannot dispose of the humidity from the exhaust air and have, owing to the danger of freezing, a low efficiency.

In heated spaces where people are constantly present the surface temperature at the walls is also of great importance. Owing to the transfer resistance of the wall surfaces this temperature is always lower than the air temperature, which gives rise to so-called drafts and discomfort by way of irregularity in heat radiation.

The ventilating wall element of this invention transmits both humidity and heat from the exhaust air (fresh air) to the fresh air (exhaust air), as a result of which the energy losses arising in the course of ventilation are eliminated. Furthermore, the wall surface temperature becomes the same as that of the room air.

These characteristics are achieved owing to the fact that the element is designed as a heat exchanger of counterflow type and is produced entirely or in part of moisture-permeable material as well as in that the exhaust air is blown in at the rear of the wall surface.

The element is functionally symmetrical and can be used equally well for heated and for cooled spaces. Described below is an embodiment of an element intended for heated spaces and produced of cardboards:

List of figures (see drawing)

FIG. 1: The element seen from the room, from the side and from above.

FIG. 2: Detail A of an enlarged horizontal section.

FIG. 3: Detail B of an enlarged vertical section.

Figure 1:
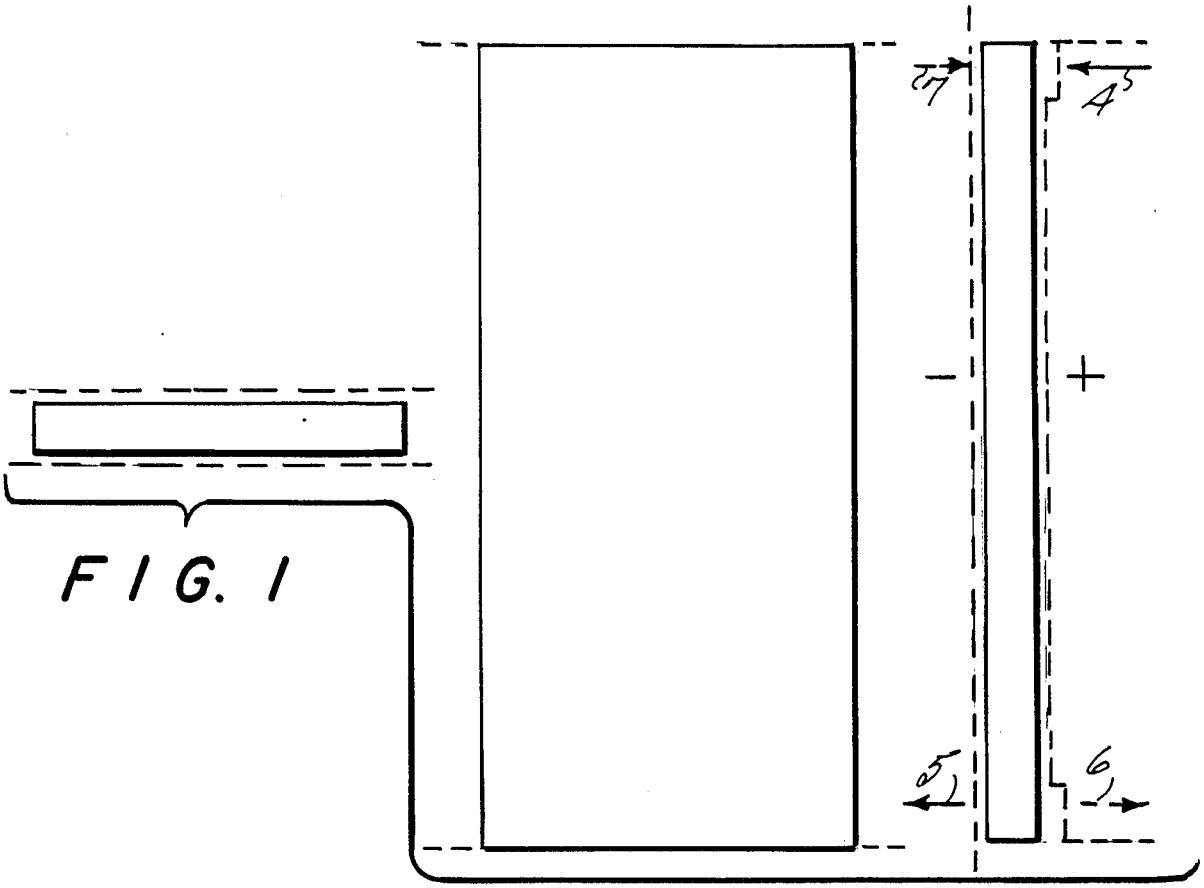
Figure 2:
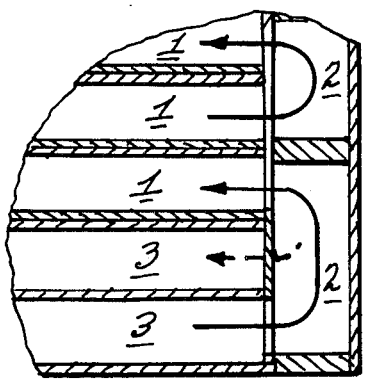
Figure 3:
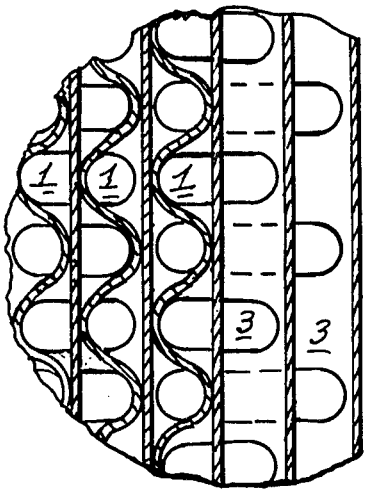
Figure 4:
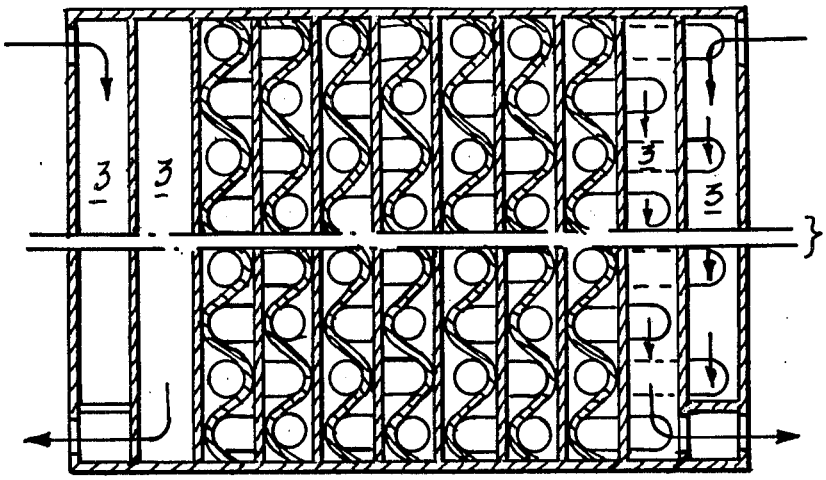
FIG. 4 is a view along lines A—A of FIG. 5.
Figure 5:
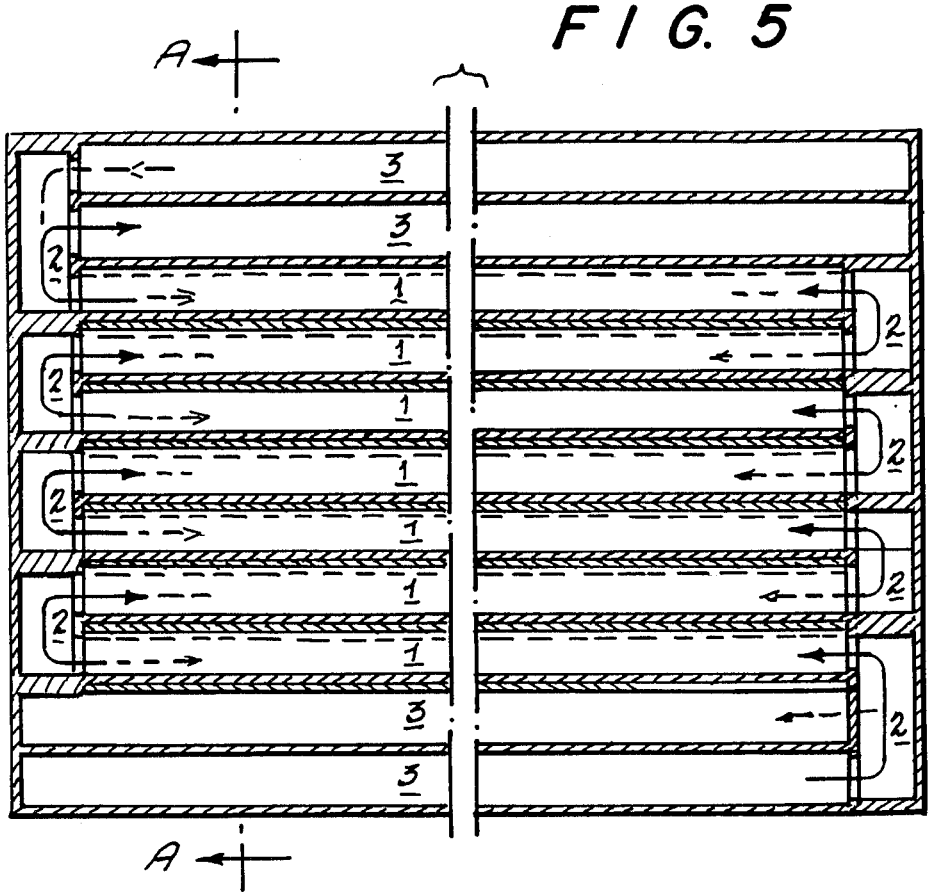
FIG. 5 is an enlarged view of the ventilator as shown in detail in FIG. 2.

The element consists of thin vertical layers comprising narrow horizontal ducts (1) alternating for exhaust air and fresh air respectively. The ends of the element contain ducts (2) linking the above-mentioned ducts. The two outer layers on both sides of the element do not contain ducts and operate as pressure equalizing chambers (3).

The exhaust air is blown into the element from a header ducts (4) at the ceiling. The velocity is regulated with the aid of a fan. The air leaves the element through small openings at the bottom (5).

Fresh air is sucked in by the negative pressure at skirting (6) and enters the element through small openings at the top (7). If the required negative pressure is not available, use is made of a ducted fan also for the fresh air.

The air velocity is so adjusted as to counteract the natural convection. If the fan is not switched on the element acts as a conventional heat insulation.

The parameters for the element are on the one hand the temperature drop at right angles to the plane of the element, and on the other hand the temperature drop along the plane of the element. The temperature drop along the plane of the element, i.e. through the duct walls characterises the element's efficiency as regards heat recovery. The latter is controlled by the duct length (and choice of material). The amounts of air are controlled by the combined cross-sectional area of the ducts (and the air velocity).

Since the exhaust air gives off the major part of its humidity prior to cooling, formation of ice is of less importance under normal conditions. If required defrosting is effected by increasing the air velocity and reducing the amount of fresh air through valves, as a result of which the element heats up.

I claim:

1. A ventilating wall element for ventilation and heat insulation between an inside and an outside space subject to different temperatures, where air from these spaces is conducted subject to induced pressure through a system of ducts so that the air from one space is separated from the air from another space by thin wall means for exchanging heat and humidity therebetween, the improvement comprising said element having a wall surface, a plurality of ducts extending parallel to said wall surface, a plurality of connecting duct means, each connecting duct means interconnecting a pairs of said parallel extending ducts at one of their respective ends to form a plurality of parallel S-shaped, uniplanar air flow paths, air being conducted in opposite directions through adjacent ducts, some of said air flow paths being exposed to air from one of said spaces and others of said air flow paths being exposed to air from the other of said spaces so that adjacent air flow paths carry air from different ones of said spaces;

and further comprising means for equalizing pressures between said some and said other parallel extending ducts, said pressure equalizing means including: (a) a first chamber having a shock absorbing capacity for receiving inlet air, and (b) a second chamber having a shock absorbing capacity for containing outlet air, said pressure equalizing means thereby functioning as a shock absorber and minimizing the coupling of air turbulence from one space to the other space.

* * * * *